US006823162B2

(12) United States Patent
Terry et al.

(10) Patent No.: US 6,823,162 B2
(45) **Date of Patent: *Nov. 23, 2004**

(54) ENDLESS BELT DRY TONER AGITATOR

(75) Inventors: James P. Terry, Garden Valley, ID (US); Paxton J. Tupper, Meridian, ID (US); Daniel E. Costello, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/661,344

(22) Filed: Sep. 12, 2003

(65) Prior Publication Data

US 2004/0081487 A1 Apr. 29, 2004

Related U.S. Application Data

(63) Continuation of application No. 10/282,471, filed on Oct. 29, 2002, now Pat. No. 6,671,481.

(51) Int. Cl.[7] ..... G03G 15/08

(52) U.S. Cl. ..... 399/258; 399/262; 399/263

(58) Field of Search ..... 399/119, 120, 399/258, 262, 263

(56) References Cited

U.S. PATENT DOCUMENTS

| | | | | | |
|---|---|---|---|---|---|
| 4,417,802 | A | * | 11/1983 | Forbes, II | 399/258 |
| 4,477,173 | A | * | 10/1984 | Kozuka et al. | 399/258 |
| 4,913,087 | A | * | 4/1990 | Saita et al. | 399/262 |
| 5,220,385 | A | * | 6/1993 | Surti | 399/258 |
| 6,546,216 | B2 | * | 4/2003 | Mizoguchi et al. | 399/258 |
| 6,671,481 | B1 | * | 12/2003 | Terry et al. | 399/258 |

* cited by examiner

*Primary Examiner*—William J. Royer

(57) ABSTRACT

A toner cartridge includes a housing which defines a toner reservoir. A rotatable endless belt is located within the toner reservoir. The belt can be used to agitate or stir toner which can be placed in the toner reservoir. In one example the belt has periodic openings in the belt which allow toner to pass through the belt so that agitated toner can be provided to toner distribution components within and outside of the toner cartridge.

20 Claims, 6 Drawing Sheets

ENDLESS BELT DRY TONER AGITATOR

This application is a continuation of Ser. No. 10/282,471 filed on Oct. 29, 2002 now U.S. Pat. No. 6,671,481.

BACKGROUND

In an electrophotographic imaging process a dry toner ("toner") is fused to a sheet of imaging media (such as paper or a transparency, for example) to generate an image on the imaging media. This process is well understood in the art, and is accomplished using an electrophotographic imaging apparatus such as a printer, a photocopier, a facsimile machine, or a multi-function apparatus which performs one or more of the processes of printing, photocopying, or printing facsimiles. Toner is typically provided to an imaging producing section of the imaging apparatus from a toner reservoir, which can be a removable toner cartridge or a replenishable reservoir which is resident within the imaging apparatus.

Toner generally includes color particles (generally microscopic particles such as carbon or colored plastic). Toner can also include carrier particles. In certain instances, the color particles are capable of carrying an electrostatic charge, allowing them to be moved by an electrostatic process from the toner reservoir to an image producing section of the imaging apparatus. In other applications, the carrier particles carry an electrostatic charge to thereby facilitate movement of the color particles. (It should be noted that by "color" we mean to include black, as well as other colors.)

In the electrophotographic imaging process toner is moved from a toner reservoir to the image producing section of the imaging apparatus. The image producing section includes a photosensitive conductor, or photoconductor, which is typically a drum or a roller. The photoconductor can be selectively exposed by an energy source, such as a pulsed laser, to electrostatically produce a portion of an image on the photoconductor. Toner particles from the toner reservoir are then either repelled or attracted to the photoconductor, based on the relative electrostatic charge differential there between. For example, if a photoconductor is initially charged with a positive electrical charge and then portions thereof are exposed to produce a lesser positive charge (or a neutral or negative charge), then positively charged toner will be attracted to the exposed areas, and repelled from the non-exposed areas. The toner is then electrostatically transferred from the photoconductor to either a sheet of imaging media, or to an intermediate transfer carrier (such as a belt or a drum) which subsequently transfers the toner to imaging media. The toner is then fused to the sheet of imaging media in a fusing section of the imaging apparatus, and the media is then deposited in an output tray. The imaging apparatus thus further includes a media transfer section to facilitate movement of the imaging media from a media supply point to the toner transfer point, and thence to the fusing section and the output tray.

Because toner generally is made from near-microscopic particles, it takes on the form of a powder. The toner resident within a toner reservoir will thus tend to settle and densify over time due to gravity. However, for the electrophotographic imaging process to be particularly effective, the toner needs to be available to the photoconductor in an essentially fluidic state during the imaging process. Fluidizing the toner allows better distribution of the toner over the photoconductor, and also helps to ensure that any carrier particles are well distributed among color particles. Accordingly, most toner reservoirs include an agitator which agitates or "stirs" the toner at least during the electrostatic imaging process.

To better understand the present invention, a brief reference will be made to a conventional prior art developing device using a toner cartridge, shown in FIG. 1. As depicted, a toner cartridge 1 stores a toner (not shown) therein. The cartridge 1 has a casing or housing 2 which defines a toner reservoir 19, and which accommodates an agitator 3 and a magnetic roller 4. The agitator 3 is rotated to agitate the toner existing in the housing 2. The housing 2 is formed with a plurality of toner outlets 5, only one of which can be seen in FIG. 1. A developing device 6 has a casing 7 which includes a toner storing section, or hopper as referred to hereinafter, 8. An agitator 9 is rotatable in the hopper 8 for agitating the toner existing in the hopper 8. A toner inlet 10 is formed in a portion of the casing 7 which faces the toner outlets 5 of the cartridge housing 2. A developing roller 11 causes the toner to deposit thereon. A doctor blade 12 causes the toner to form a thin layer on the surface of the developing roller 11. An intermediate roller 13 is held in contact with the developing roller 11, so that the toner is transferred from the roller 11 to the roller 13. A photoconductive element in the form of a drum 14 is held in contact with the intermediate roller 13. The toner is transferred from the roller 13 to the drum 14 in order to develop a latent image electrostatically formed on the drum 14. The resulting toner image is transferred from the drum 14 to a paper or similar recording medium "M" by an image transfer unit 15. A cleaning unit 16 cleans the surface of the drum 14 after the image transfer. A charger 17 uniformly charges the surface of the drum 14. An exposing device 18 exposes the charged surface of the drum 14 imagewise so as to form the latent image.

The agitator 3 of the toner cartridge 1 of FIG. 1 can be provided with a flexible blade 20 which can conform to the shape of the interior of the housing 2 as the agitator 3 rotates in the direction indicated by the arrows. While some toner cartridges have toner reservoirs with complex interior shapes, generally the cross sectional shape of the toner reservoir area can be described as non-square in cross section. This non-square geometry helps to maintain contact between the flexible scraper blade 20 and the walls of the toner reservoir. Accordingly, toner storage volume in the toner reservoir is impacted by not being able to use a geometry that is more square or rectangular in cross section than prior art toner reservoirs. That is, it is not always possible to maximize the toner storage volume within the available space in a toner cartridge, since prior art toner reservoirs are generally configured to ensure that prior art agitators will be able to access the entire toner reservoir. Put another way, toner cartridges are typically configured to fit within an imaging apparatus based on the presence of ancillary components located within the imaging apparatus. The exterior dimensions imposed on a toner cartridge by these ancillary components thus define a maximum toner reservoir volume which can be achieved in a toner cartridge. Yet prior art toner agitators do not always allow the maximum available volume to be utilized due to the need to accommodate the limitations of prior art agitators.

In addition to toner cartridges which do not include the photoconductor (as depicted in FIG. 1), other prior art toner cartridges are known which incorporate the photoconductor. One such example is depicted in FIG. 2, which shows a toner cartridge 30 having a housing 31 which defines a toner reservoir 32 in which is located an agitator 34. Toner from within the reservoir 32 egresses through outlet opening 35 to a hopper area 36. An application roller 38 applies toner from the hopper area 36 to the optical photoconductor ("OPC")

40, which has been charged by charge roller 42. A scraper blade 44 removes any residual toner from the OPC 40 after toner has been transferred from the OPC to a sheet of imaging media (not shown), and the waste toner is stored in a waste storage area 46. Agitator 34 of toner cartridge 30 is depicted in a front view in FIG. 3. As can be seen, the agitator 34 includes two blade portions 50 which are supported by, but distal from, a central shaft 48, thus creating open areas 52. The open areas 52 allow the toner to "fluff" or volumize as it is agitated, rather than merely being pushed around inside the toner reservoir 32 (FIG. 2).

Other types of prior art toner agitators are known. For example, U.S. Pat. No. 5,307,129 shows a spiral toner agitator, and U.S. Pat. No. 5,305,064 shows a toner agitator which includes a rotating tube with holes disposed in the tube to allow toner to pass in and out of the holes as the toner is agitated.

In addition to generally limiting the geometry of the toner reservoir, prior art toner agitators do not always produce an even distribution of toner at the location where the toner is transferred out of the toner reservoir. This can result in uneven distribution of the toner on the OPC, and consequently a printed image of uneven color density.

What is needed then is a toner reservoir agitator which achieves the benefits to be derived from similar prior art devices, but which avoids the shortcomings and detriments individually associated therewith.

SUMMARY

One embodiment of the present invention provides for a toner cartridge which includes a housing which defines a toner reservoir. A rotatable endless belt is located within the toner reservoir. The belt can be used to agitate or stir toner which can be placed in the toner reservoir. In one example the belt has periodic openings in the belt to allow toner to pass through the belt so that agitated toner can be provided to toner distribution components which can be present within, and/or outside of, the toner cartridge.

Another embodiment of the present invention provides for an imaging apparatus having a toner reservoir housing which defines a toner reservoir. A rotatable endless belt is disposed within the toner reservoir in the manner described in the paragraph immediately above. Yet another embodiment of the present invention also provides for a toner supply system which is resident within an imaging apparatus. In this latter embodiment, the toner supply system has a toner reservoir and a rotatable endless belt which is located within the toner reservoir. The belt can be used to agitate toner within the toner reservoir.

In one non-limiting example of the present invention the rotatable endless belt is supported by a drive roller which can be used to cause the belt to rotate within the toner reservoir. The belt can also be supported by additional rollers, which can be driven or idle. The belt can also be driven by, and supported by, other means.

DETAILED DESCRIPTION

A dry toner agitation system which includes an endless, rotatable belt (an "agitator belt") that is located within a dry toner reservoir will now be described. The belt defines a generally enclosed inner volume in which can be located dry imaging toner. Preferably, the agitator belt has openings disposed therein to allow toner to pass from the inner volume, through the belt, and thence to an external space. The external space is in fluid communication with additional toner distribution components, as for example a toner distribution roller, a toner application roller, and/or an optical photoconductor. Embodiments of the present invention are applicable to both toner cartridges which can be inserted into, and removed from, an imaging apparatus, as well as fixed toner supply systems which are resident within an imaging apparatus.

The agitator belt can be made from a flexible material which allows the belt to be supported within the toner reservoir in close proximity to the principle surface which defines the toner reservoir. This allows a toner reservoir to be configured to maximize toner storage volume within the constraints set by the shape of the toner cartridge itself, without having to limit the size and shape of the reservoir to accommodate the agitator. Exemplary materials of construction for the belt include rubber, neoprene, polyester, and thin sheets of plastic, polyethylene and TFE.

Toner reservoirs are generally defined by a major longitudinal dimension. In one embodiment of the invention the agitator belt spans the majority of this major longitudinal dimension within the toner reservoir. In this way the belt is generally in contact with the toner across the entire major longitudinal dimension of the toner reservoir, allowing for an even supply of the toner to other toner distribution components (e.g., application rollers, transfer rollers, the optical photoconductor ("OPC"), etc.). Further, since the endless belt contacts toner about the entire 360 degree of the internal periphery of the belt, greater contact is achieved between the toner and the agitator, thus resulting in enhanced volumization (or agitation) of the toner. (As used herein, the term "volumization" means mixing a dry solid powder, such as toner, with air to achieve an essentially fluidic state of the powder.) Thus, in addition to allowing toner storage volume to be increased within a toner cartridge, the toner agitator belt can provide a more evenly distributed supply of toner to toner distribution components and ultimately to the OPC and the imaging media.

We will now describe specific embodiments and examples of toner agitators, toner cartridges, and toner supply systems. However, it will be understood that the following embodiments and examples should not be considered as limiting the scope of the present invention.

Figure 1:
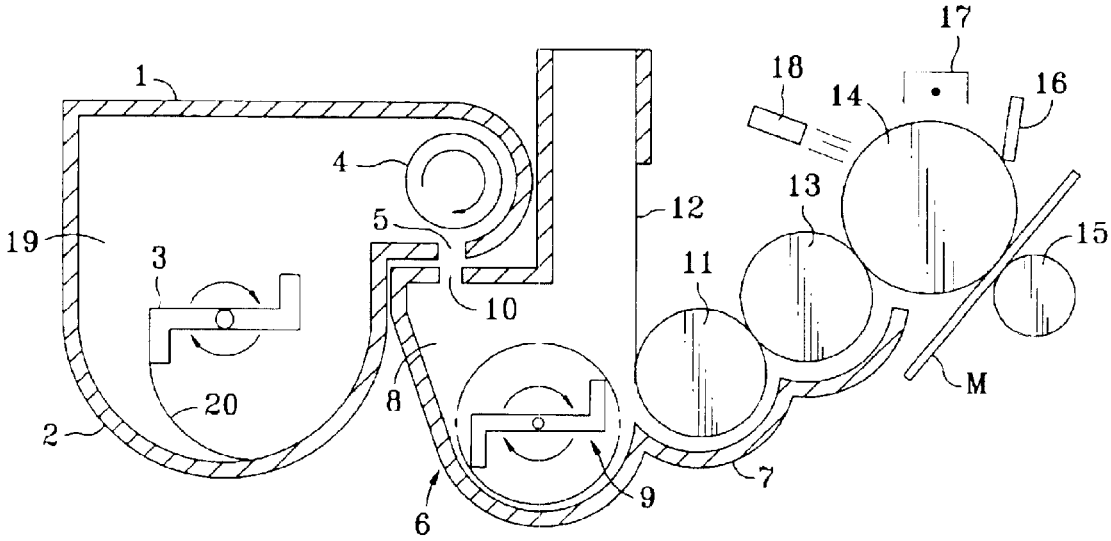
FIG. 1 (Prior Art)
FIG. 1 is a cross sectional side view depicting a portion of a prior art imaging apparatus and a prior art toner cartridge.
Figure 2:
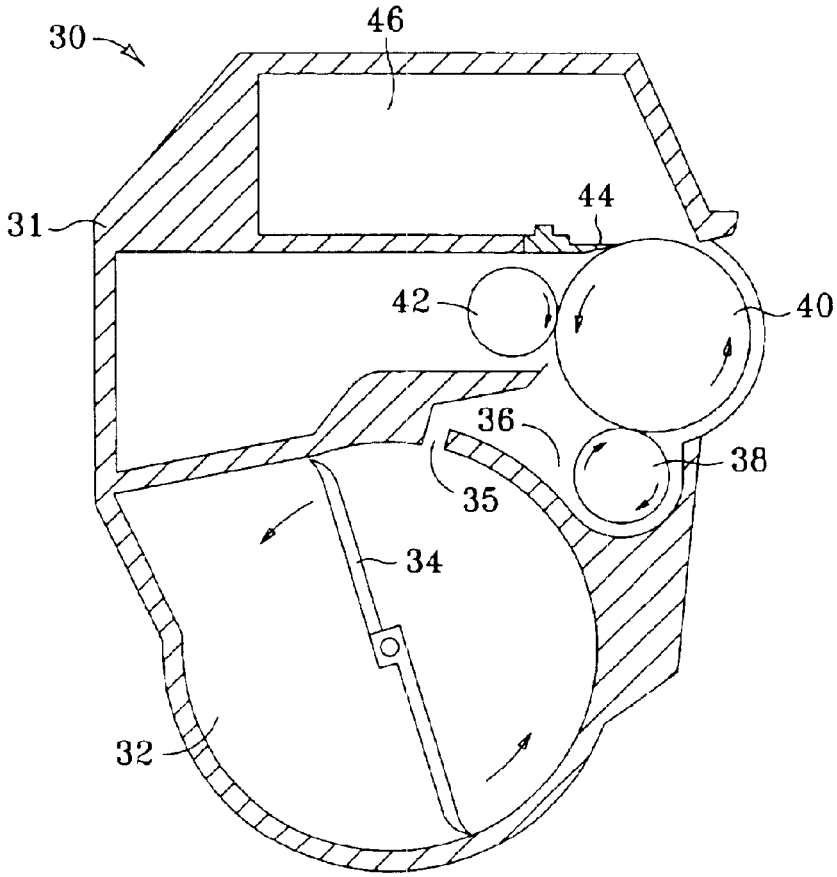
FIG. 2 (Prior Art)
FIG. 2 is a cross sectional side view depicting another prior art toner cartridge.
Figure 3:
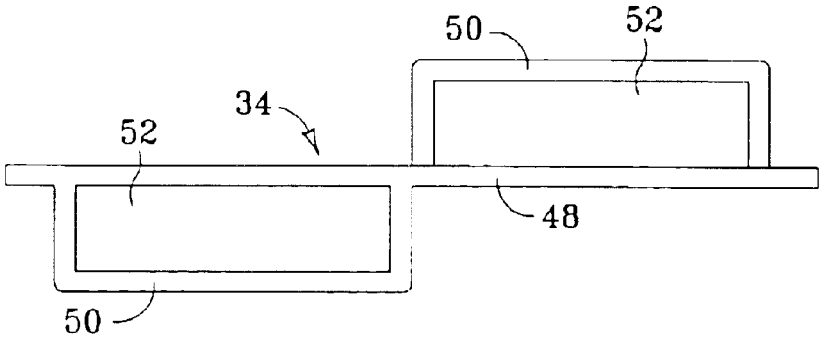
FIG. 3 (Prior Art)
FIG. 3 is a front view of the agitator of the prior art toner cartridge depicted in FIG. 2.
Figure 4:
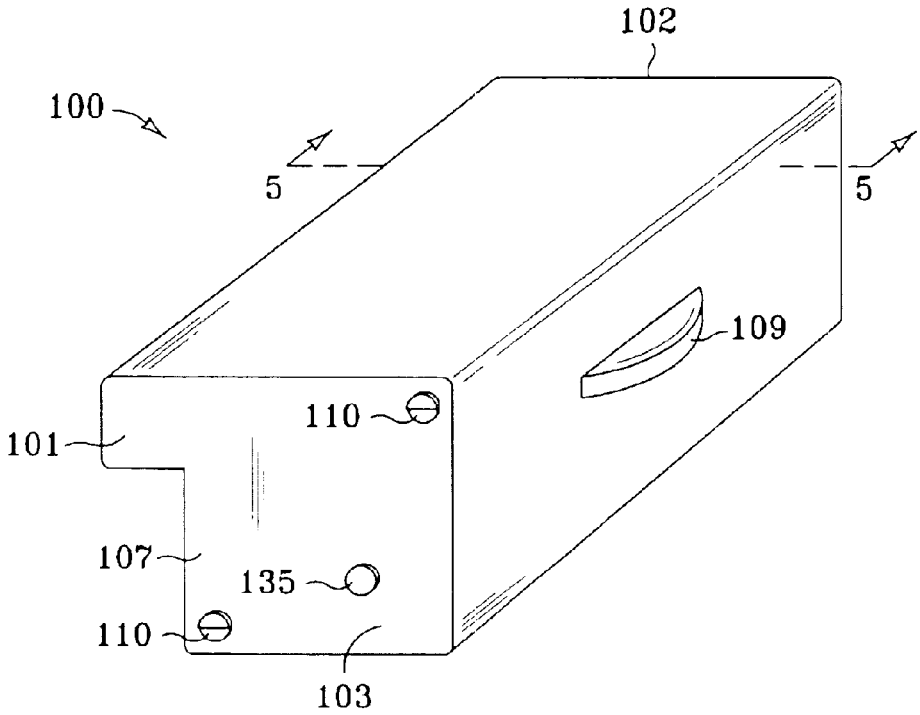
FIG. 4 is an oblique diagram depicting a dry toner cartridge in accordance with one embodiment of the present invention.

Turning now to FIG. 4, an oblique diagram of a toner cartridge 100 is depicted in an oblique view. The toner cartridge 100 includes a housing 102, which is shown as having a handle 109 (to facilitate insertion and removal of the cartridge 100 from an imaging apparatus), and a side panel 107 which is in a generally square or rectangular shape and which generally defines the toner reservoir area 103. The toner cartridge 100 further includes a toner discharge zone 101, which extends from the toner reservoir area 103 and provides a toner distribution outlet area for toner to be distributed to additional toner distribution components, such as an OPC (see OPC 14 of FIG. 1, for example). As depicted in FIG. 4, the toner cartridge 100 further includes two drive connections 110, the operation of which will be described further below.

Figure 5:
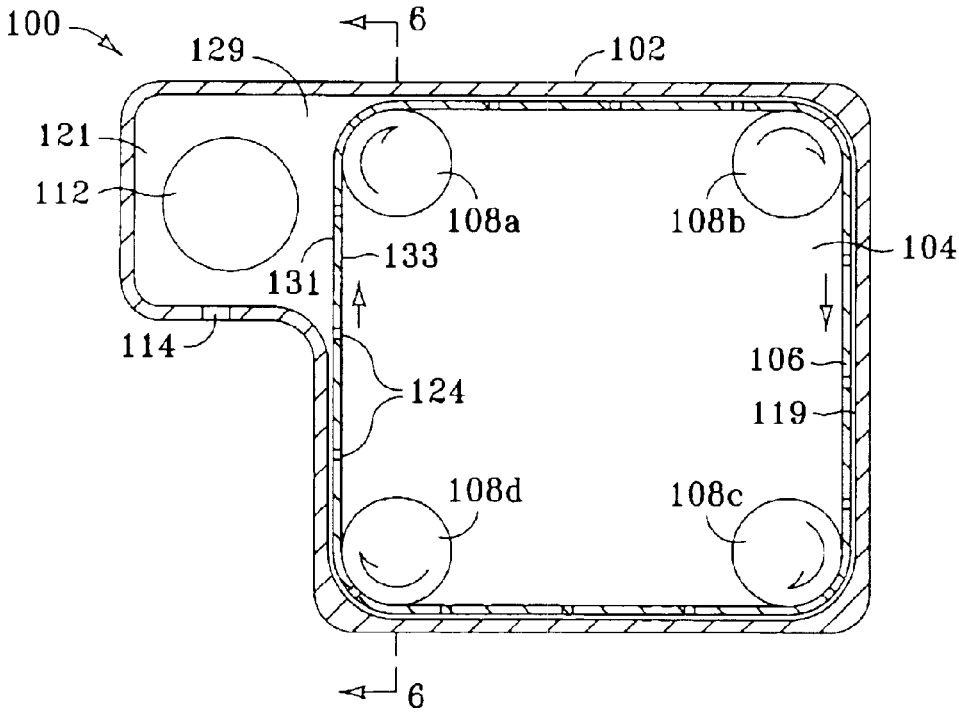
FIG. 5 is a cross sectional side view of the toner cartridge of FIG. 4.

FIG. 5 depicts a side cross sectional view of the toner cartridge 100 of FIG. 4. The housing 102 generally defines a toner reservoir 104 (in which toner can be stored), a toner distribution outlet area 121, and a toner egress area 129 which allows toner to move from the toner reservoir 104 to the toner distribution outlet area 121. In the example depicted, a transfer roller 112 is located in the toner distribution outlet area 121. A toner outlet opening 114 allows toner to exit from the toner cartridge 100 to other toner distribution components (similar to outlet opening 5 of the prior art toner cartridge 1 of FIG. 1). Disposed within the toner reservoir 104 is a rotatable endless belt 106, which can also be described as a toner agitator belt, or "agitator belt". The toner reservoir 104 is generally defined by a reservoir primary surface 119 within the housing 102, and preferably the rotatable endless belt 106 is positioned proximate the reservoir primary surface 119. The agitator belt 106 is defined by an outer belt surface 131, which can be proximate the reservoir primary surface 119, and an inner belt surface 133 which is opposite the outer belt surface 131. The area within the toner reservoir 104 which is proximate to the inner belt surface 133 defines a mixing region. During manufacture of the toner cartridge 100, toner can be added to the toner reservoir 104 via a toner inlet opening (not shown), which can then be plugged by a plug 135 (FIG. 4), thus generally filling the volume defined by the inner belt surface 133 and the ends (or side panels 107, FIG. 4) of the toner cartridge 100. As will be described further below with respect to FIG. 6, the agitator belt 106 can generally span the major longitudinal length of the toner reservoir 104 (i.e., the dimension into the sheet on which FIG. 5 is drawn, generally corresponding to the depth dimension of the oblique drawing of the cartridge 100 of FIG. 4).

The agitator belt 106 is depicted in FIG. 5 as being positioned within the cartridge housing 102 so as to have a space between the belt outer surface 131 and the reservoir primary surface 119. However, the outer surface 131 of the belt 106 can be in contact with the reservoir primary surface 119 to prevent accumulation or caking of toner between the belt 106 and the housing 102. Other means of preventing caking of toner in this area will be describe further below.

As depicted in FIG. 5, the toner cartridge 100 further includes a plurality of rollers 108*a*–108*d* which can support the rotatable endless belt 106 in proximity to the reservoir primary surface 119. However, it is not required that the agitator belt 106 be located adjacent to the reservoir primary surface 119. At least one of the rollers 108*a–d* can be connected to a drive connection which allows the belt 106 to be rotated within in the toner reservoir 104. For example, FIG. 4 depicts drive connections 110 which are located proximate an exterior surface (side panel 107) of housing 102. As will be described with respect to FIG. 6 below, drive connections 110 of FIG. 4 can be connected to rollers 108*b* and 108*d* of FIG. 5. The drive connectors 110 can be engaged by a drive mechanism (not shown) within an imaging apparatus which is configured to receive the toner cartridge 100. The drive mechanism can then be used to actuate the rotatable belt 106, causing the belt to rotate within the toner reservoir 104 and thereby agitate or stir the toner. In most configurations the drive mechanism is only actuated when the imaging apparatus receives a command to generate an image, thus reducing wear on the drive mechanism and the agitator belt 106.

Figure 6:
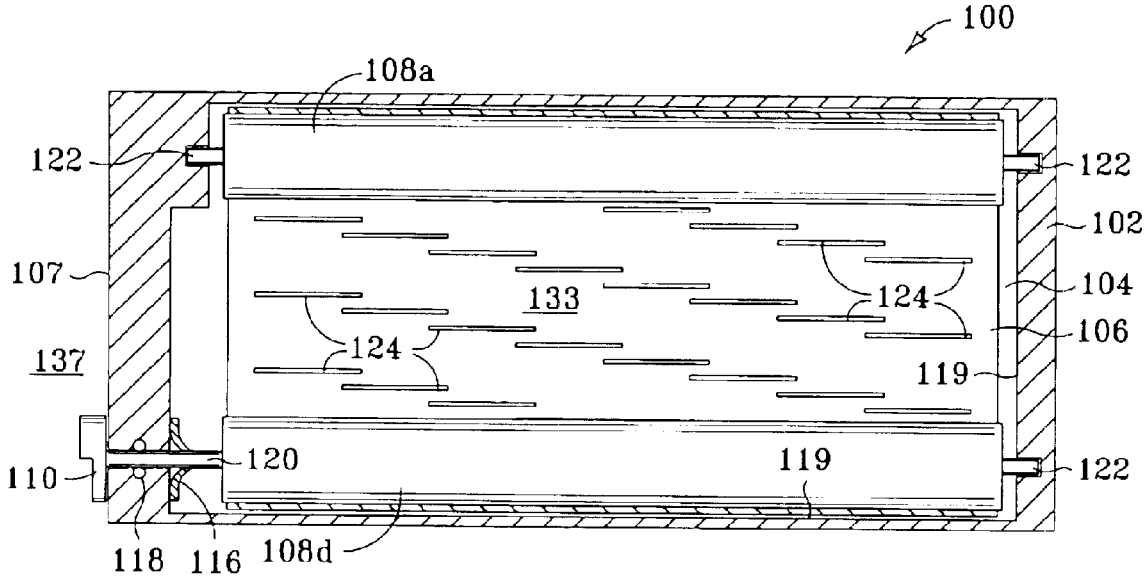
FIG. 6 is a cross sectional front view of the toner cartridge of FIGS. 4 and 5.

Turning now to FIG. 6, a cross sectional front view of the toner cartridge 100 of FIGS. 4 and 5 is depicted. As can be seen, the cartridge housing 102 defines the toner reservoir volume 104, in which the agitator belt 106 is disposed. Support rollers 108*a* and 108*d* can be seen supporting the belt 106 in proximity to the reservoir primary surface 119. Support roller 108*d* is a drive roller, and is connected by drive shaft 120 to drive connection 110 (also seen in FIG. 4). Roller 108*a* is not connected to a drive connection, but is merely supported in the housing 102 by cylindrical supports 122. Roller 108*a* can thus be considered an idler roller (i.e., it does not contribute a motive source to the rotational actuation of belt 106, but merely functions to hold the belt 106 in position (in this case, proximate to the reservoir primary surface 119)). Returning briefly to FIG. 5, it can be seen that rollers 108*b* and 108*d* are respective first and second drive rollers, and rollers 108*a* and 108*c* are respective first and second idler rollers. The drive shaft 120 (FIG. 6) can be sealed between the toner reservoir 104 and the ambient atmosphere 137 by a sealing means to impede toner from exiting the toner reservoir 104 to the ambient atmosphere 137. Exemplary sealing means include, for example, O-ring 118 and/or seal 116. O-ring 118 and seal 116 can be fitted into, or attached to, housing 102, and placed in contact with the drive shaft 120. Suitable materials for O-ring 118 and seal 116 include silicon impregnated elastomers.

Figure 7:
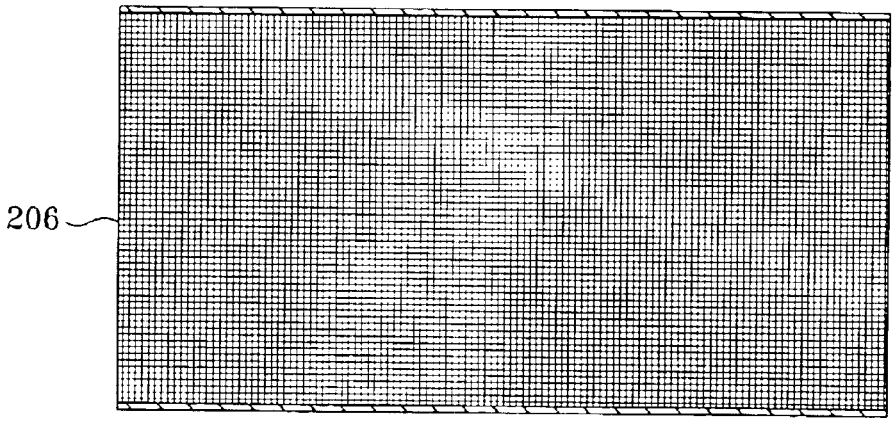
FIG. 7 is a front view of a mesh belt that can be used as a toner agitator belt in accordance with an embodiment of the present invention.

As can be seen in FIG. 6, the rotatable endless agitator belt 106 is preferably provided with perforations or openings 124 to allow toner to pass from the toner reservoir area 104 though the belt 106. In this way, toner can move from the toner reservoir 104 to the toner reservoir egress area (129, FIG. 5). As depicted in FIG. 6, the openings in belt 106 are longitudinal slits 124. In this example the transfer belt 106 can be a belt fabricated from a material such as rubber or neoprene, or a thin sheet of a plastic such as polyethylene or nylon, and the slits 124 can be stamped from the sheet material. However, other configurations can be used to allow toner to pass through the agitator belt 106. For example, the agitator belt can be fabricated from a plastic mesh, as shown in FIG. 7, which depicts a front view of a toner agitation belt 206 (similar to the view of belt 106 in FIG. 6). Belt 206 of FIG. 7 can also be fabricated from a plastic mesh extrusion which thus produces an elongated closed ("endless") hollow member which can be then be cut into the desired belt lengths. Such plastic mesh netting extrusions are available, for example, from U.S. Netting of Erie, Pa. Extruded mesh netting can be produced in a wide range of thicknesses and aperture sizes. The material's thickness, weight, mesh size, and strand shape can be altered to meet various design criteria, such as toner particle size and desired migration rates of toner through the openings. The agitator belt also can be fabricated from a polyester mesh, available for example from Satoh & Co., Ltd. of Yodogawa-ku, Osaka, Japan.

Figure 8:
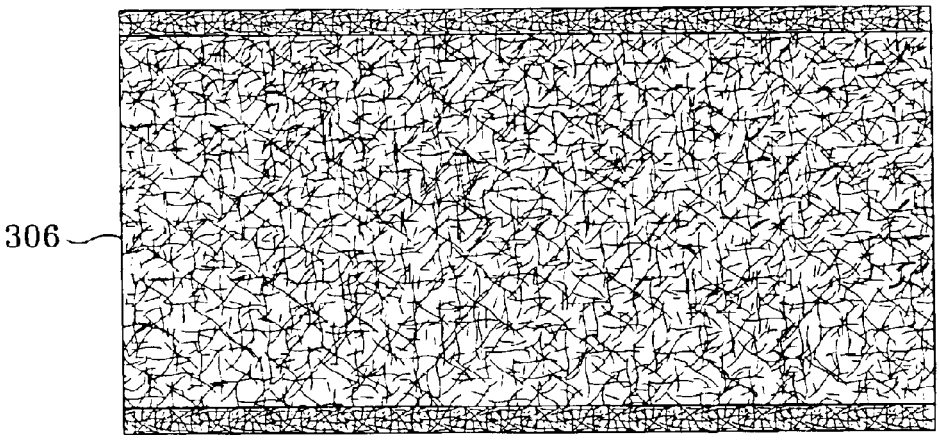
FIG. 8 is a front view of a belt made from fused plastic fibers that can be used as a toner agitator belt in accordance with the another embodiment of present invention.

In yet another example a toner agitator belt in accordance with an embodiment of the present invention can be fabricated from a plurality of plastic strands or fibers which are fused to one another at random sites along the fibers to thereby produce a cohesive belt having relatively random openings (toner passageways) defined therein. Such a configuration is shown in FIG. 8, which depicts a front sectional view of a toner agitator belt 306 (similar to the view of belt 106 depicted in FIG. 6) which is generally made from a plurality of plastic fibers (not specifically indicated) that are randomly fused together along various points along the fibers, to thereby produce an essentially toner-permeable agitator belt 306. The permeability of the agitator belt 306 (i.e., permeability to toner particles passing therethrough) can be adjusted based on the length of the plastic fibers, the diameter of the plastic fibers, the final thickness of the belt which results from stacking the plastic fibers on top of one another, and the number of points along each fiber at which it is fused to adjacent fibers.

Figure 9:
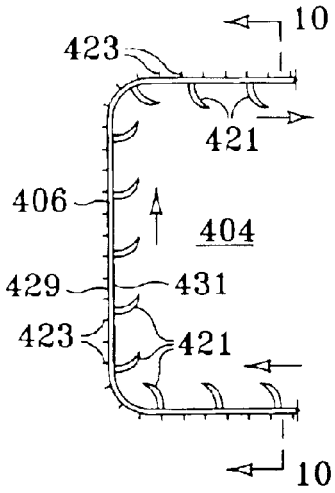
FIG. 9 is a partial side view of another belt that can be used as a toner agitator belt in accordance with yet another embodiment of the present invention.

Turning now to FIG. 9, another rotatable endless belt (or "agitator belt") 406 that can be used as a toner agitator in accordance with yet another embodiment of the present invention is depicted in a partial side sectional view (similar to the left side of belt 106 of FIG. 6). The rotatable endless belt 406 is defined by an outer belt surface 429 which is can be oriented proximate the reservoir primary surface (such as surface 119 of cartridge 100 of FIG. 5). The rotatable endless belt 406 is further defined by an inner belt surface 431 which is opposite the outer belt surface 429. The belt 406 includes a plurality of scraping members 423 which protrude from the outer belt surface 429, and which can contact the reservoir primary surface (such as surface 119 of cartridge 100, FIG. 5) to thereby scrape any toner off of the reservoir primary surface, thereby reducing the tendency for toner to cake or accumulate between the reservoir primary surface (e.g., surface 119 of FIG. 5) and the belt outer surface (e.g., belt surface 429, FIG. 9).

Figure 10:
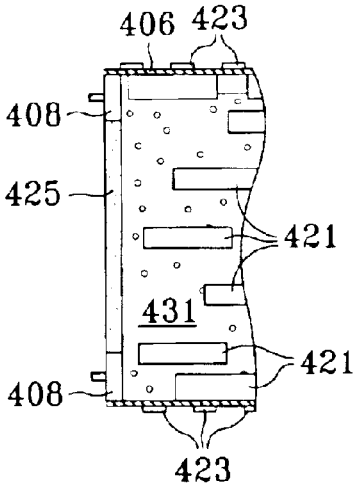
FIG. 10 is a cross sectional front view of the toner agitator belt depicted in FIG. 9.

FIG. 9 also shows how stirring members 421 can be attached to the inner surface 431 of the agitator belt 406. The stirring members 421 can aid in agitating toner in the toner reservoir 404 as the belt 406 is rotated. Turning to FIG. 10, a front partial sectional view of the belt 406 is FIG. 9 is depicted. As can be seen, the stirring members 421 can be staggered to provide a more random stirring action. Since the stirring members 421 protrude above the inner surface 431 of the belt 406, they can interfere with support rollers, such as rollers 108*a–d* of FIG. 5. To address this situation the agitator belt 406 can be supported by shortened rollers 408 which do not transit the entire width of the belt 406 (as do rollers 108*a–d* of FIG. 5). Further, the edges of the agitator belt 406 can be provided with roughened track areas 425 to allow a driven one of the rollers 408 to gain traction on the belt 406. Further, belt 406 can be fabricated from a relatively stiff material (such as an extruded polyethylene mesh) so that the belt does not appreciably sag near the middle of the belt. Alternately, a shaft can pass between rollers 408 on opposite sides of the toner belt 406 (only the left side rollers are shown in FIG. 10), and intermediate rollers can be placed on the shaft to provide support for the belt.

Figure 11:
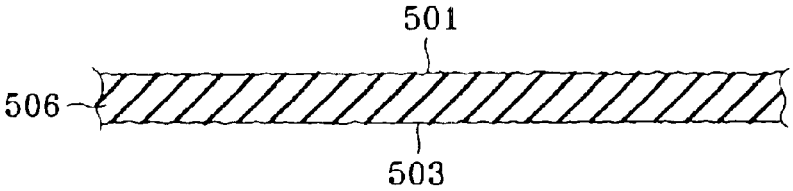
FIG. 11 is a cross sectional diagram of another type of belt that can be used as a toner agitator belt in accordance with still another embodiment of the present invention.

Turning now to FIG. 11, a partial front sectional view of another agitator belt 506 that can be used is depicted. The view in FIG. 11 corresponds to viewing the thickness of the belt after it has been sectioned, similar to the upper and lower sections of the belt 406 which is depicted in FIGS. 9 and 10. As depicted in FIG. 11, the outer surface of the belt 506 is indicated by edge 501, and the inner surface of the belt is indicated by edge 503. As indicated in FIG. 11, one or both of the outer surface 501 or the inner surface 503 of the belt 506 can be roughened to provide the advantages described above with respect to belt 406 of FIGS. 9 and 10. That is, the roughening on the outer surface 501 of the belt 506 can facilitate scraping toner off of the toner reservoir primary surface (such as surface 119 of FIG. 5), while the roughening on the inner surface 503 of the belt 506 can facilitate stirring of toner within the toner reservoir (such as reservoir 104 of FIG. 5). The roughening can be provided by texturing the material out of which the belt 506 is fabricated, or by applying roughening agents (such as plastic granules) to the surfaces of the belt.

Figure 12:
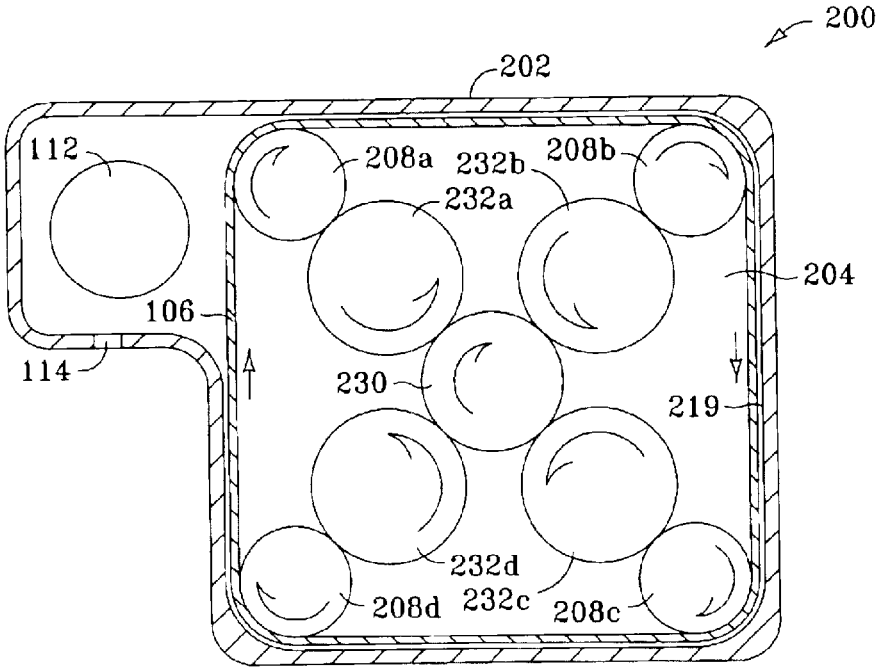
FIG. 12 is a cross sectional side view of a toner cartridge similar to the cartridge depicted in FIG. 5, but having a different system for driving the toner agitator belt.

In the description of FIGS. 4 through 6 above it was described how driven rollers 108*b* and 108*d* (FIG. 5) can be used to drive the belt 106 in a rotational manner. It will, however, be appreciated that other devices and structures can be used to drive a toner agitator belt in accordance with other embodiments of the present invention. One such drive system is depicted in FIG. 12. FIG. 12 depicts a side sectional view of a toner cartridge 200 in accordance with another embodiment of the present invention. The toner cartridge 200 is similar to the toner cartridge 100 depicted in FIG. 5, and contains like-numbered components which were described above with respect to FIG. 5. Specifically, the toner cartridge 200 of FIG. 12 includes a toner agitation belt (endless rotatable belt) 106, which is disposed within a toner reservoir 204 defined by housing 202. As shown, the belt 106 is supported by rollers 208*a–d* in proximity to the interior surface 219 of the toner reservoir 204. In the configuration depicted in FIG. 12, the drive system for the belt 106 includes a single drive connection which is located proximate the exterior surface of the housing (the drive connection is not shown in FIG. 12, but can be similar to drive connection 110 which is located proximate side panel 107 in FIG. 4). However, in FIG. 12 the drive connection is connected to a central driving wheel 230 (located within the toner reservoir 204). The central driving wheel 230 is in turn in contact with a plurality of secondary driving wheels 232*a–d*, and each secondary driving wheel 232*a–d* is in contact with a corresponding one of the rollers 208*a–d*. Thus, by turning the drive connection (not shown), the central driving wheel 230 drives the secondary driving wheels 232*a–d*, and consequently the rollers 208*a–d*, and thus belt 106 is moved rotationally within the toner reservoir 204. In this way all of the rollers 208*a–d* can be driven by a single connection. The drive system depicted in FIG. 12 can reduce slack forming in the agitator belt 106 since the belt will now be driven at all of the support locations (i.e., at rollers 208*a–d*). Although the central driving wheel 230 and the secondary driving wheels 232*a–d* are depicted as being rollers, they can also be geared to provide positive engagement therebetween. In this instance the ends of rollers 208*a–d* can also be fitted with gearing to positively engage the secondary rollers 232*a–d*.

It will be observed that in FIGS. 5, 6 9 and 12 the mixing region (i.e., the area within the toner reservoir (e.g., reservoir 104, FIG. 5) proximate to the inner surface of the agitator belt (e.g., belt inner surface 133, FIG. 5) is defined (in a side view) by the peripheral shape of the agitator belt (such as belt 106, FIG. 5). In the embodiments and examples depicted in FIGS. 5, 6 9 and 12, the mixing region has a non-circular shape (in side view). This non-circular shape of the mixing region allows for the volume of the toner reservoir to be increased (and thus, the quantity of toner within the reservoir) over a toner cartridge having a mixing region that is defined by a periphery that is circular in shape.

As indicated above, the present embodiments of the present invention are applicable not only to toner cartridges but also to toner systems which are resident within an imaging apparatus. Accordingly, these embodiments provide for an imaging apparatus having a toner agitating system as described herein, as well as such a toner agitating system which is resident within an imaging apparatus. One such example is provided in FIG. 13, which depicts a simplified side elevation section view of an imaging apparatus 300 (as well as a toner supply system 310 resident within the imaging apparatus 300). The imaging apparatus 300 is depicted in a simplified drawing in that the imaging components and media transport components are not shown, such being well known in the art. The imaging apparatus can be, for example, a printer, a photocopier, a facsimile machine, or a combination "multi-function" imaging apparatus.

Figure 13:
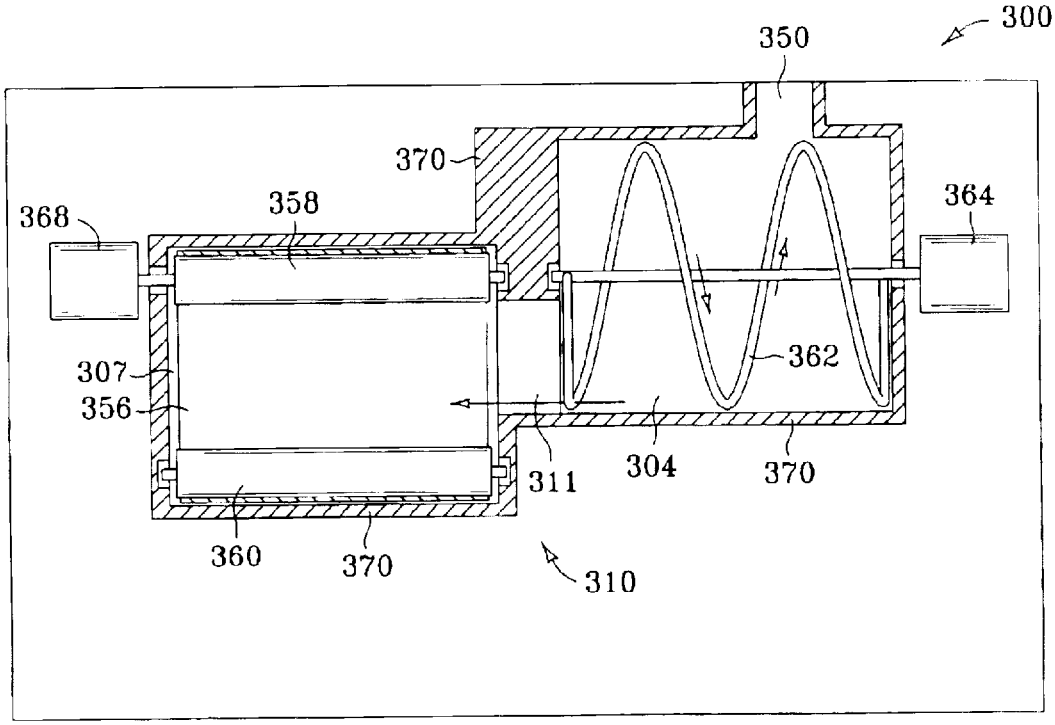
FIG. 13 is a side view depicting an imaging apparatus (simplified) having a resident toner reservoir and a toner agitating system in accordance with a further embodiment of the present invention.

As depicted in FIG. 13, the imaging apparatus 300 has a toner supply system 310 which includes a toner reservoir housing 370 which defines a toner reservoir 307. A rotatable endless belt 356 is disposed within the toner reservoir 307, and can be used to agitate toner within the reservoir 307 in the manner described above with respect to agitator belt 106 of FIG. 5. The rotatable endless belt 356 can have openings disposed therein to allow toner to pass therethrough. Examples of belt-types and opening which can be used in the toner supply system 310 include agitator belts 106 (FIGS. 5 and 6), 206 (FIG. 7), 306 (FIG. 8), 406 (FIGS. 9 and 10) and 506 (FIG. 11), all described above. The rotatable endless belt 356 can be supported by rollers 358 and 360 (generally corresponding to rollers 108*a* and 108*d* of FIG. 5), as well as other rollers which are not visible in FIG. 13. One or more of the support rollers 358, 360 can be a driven roller, also in the manner described above with respect to FIGS. 5 and 12. For example, a motor 368 can be connected to roller 358, thus making roller 358 a drive roller.

The toner supply system 310 in the imaging apparatus 300 of FIG. 13 can further include an antechamber 304 which is defined by the housing 370, and which is in fluid communication with the toner reservoir 307 by way of toner passageway 311. The antechamber 304 includes an inlet opening 350 to receive dry toner therethrough. In this way, the toner reservoir 307 can be replenished by filling the antechamber 304 with dry toner through the opening 350. A rotatable auger 362, driven by motor 364, can be provided as part of the toner supply system 310 to move toner from the antechamber 304 into the toner reservoir 307 via the toner passageway 311. Other types of material handling apparatus, such as paddles or belts, can be used in place of the auger 362 to facilitate migration of toner from the antechamber 304 into the reservoir 307.

Yet another embodiment of the present invention provides for a method of agitating toner within a toner reservoir. The method includes providing a rotatable endless belt, such as belt 106 of FIG. 5 (or 206 (FIG. 7), 306 (FIG. 8), 406 (FIG. 9) or 506 (FIG. 11)) within the toner reservoir, and rotating the belt within the toner reservoir to cause toner within the reservoir to be agitated. The belt can be placed in close proximity to a wall surface of the toner reservoir (such as interior surface 119 of FIG. 5). Further, the belt preferably has openings disposed therein to allow toner to pass through the openings as the toner is agitated by the belt. The method can further include rotating the belt during an imaging process, and not rotating the belt when an imaging process is not taking place or is not imminently ready to take place.

We claim:

1. A toner cartridge, comprising:

a housing which defines a toner reservoir; and a rotatable endless belt disposed within the toner reservoir.

2. The toner cartridge of claim 1, and wherein the toner reservoir is defined by a reservoir primary surface within the housing, and further wherein the rotatable endless belt is positioned proximate the reservoir primary surface.

3. The toner cartridge of claim 2, and wherein the rotatable endless belt is defined by an outer belt surface which is proximate the reservoir primary surface, the rotatable endless belt further comprising a plurality of scraping members which protrude from the outer belt surface.

4. The toner cartridge of claim 2, and further comprising a plurality of rollers which support the rotatable endless belt in proximity to the reservoir primary surface.

5. The toner cartridge of claim 4, and wherein the plurality of rollers comprise at least three rollers.

6. The toner cartridge of claim 4, and wherein the plurality of rollers comprise at least four rollers spaced in rectangular arrangement with respect to one another.

7. The toner cartridge of claim 2, and wherein the rotatable endless belt is defined by an inner belt surface, the rotatable endless belt further comprising a plurality of stirring members which protrude from the inner belt surface.

8. The toner cartridge of claim 1, and wherein the rotatable endless belt is formed from a material defining a mesh, a plurality of randomly fused fibers, or a material defining a plurality of longitudinal slits.

9. The toner cartridge of claim 1, and wherein the rotatable endless belt is configured to be permeable to a toner.

10. An imaging apparatus, comprising:

a toner reservoir housing which defines a toner reservoir; and a rotatable endless belt disposed within the toner reservoir, wherein the endless belt is configured to be permeable to a toner.

11. The imaging apparatus of claim 10, and wherein the rotatable endless belt is defined by an inner belt surface, the rotatable endless belt further comprising a plurality of stirring members which protrude from the inner belt surface.

12. The imaging apparatus of claim 10, and wherein the rotatable endless belt is defined by an outer belt surface, the rotatable endless belt further comprising a plurality of scraping members which protrude from the outer belt surface.

13. The imaging apparatus of claim 10, and wherein the rotatable endless belt is supported within the toner reservoir by at least three rollers.

14. The imaging apparatus of claim 13, and wherein the at least three rollers includes four rollers spaced in rectangular arrangement with respect to each other.

15. A toner cartridge comprising:

means for housing a supply of toner, said means for housing the supply of toner defining a non-cylindrical mixing region defined by a periphery; and means for engaging at least a portion of the toner at the periphery of the non-cylindrical mixing region for agitating the toner, the means for engaging at least a portion of the toner configured to be permeable to the toner.

16. A method of agitating toner, comprising:

placing toner, in a reservoir;

rotatably supporting an endless belt within the reservoir by way of at least three rollers; and engaging at least a portion of the toner in the reservoir with the endless belt to thereby agitate the toner within the reservoir.

17. The method of claim 16, and wherein the endless belt is defined by an inner belt surface and an outer belt surface, and openings disposed in the endless belt between the inner belt surface and the outer belt surface, the method further comprising:

placing the toner proximate at least a portion of the inner belt surface;

rotating the endless belt; and allowing at least a portion of the toner to pass from the inner belt surface to the outer belt surface via the openings.

18. The method of claim 16, and wherein the placing toner in a reservoir comprises placing toner in a reservoir of a toner cartridge.

19. The method of claim 16, and further comprising permeably passing a portion of the toner through the endless belt during the agitating at least a portion of the toner within the reservoir.

20. The method of claim 16, and further comprising:

providing a plurality of stirring members supported by the endless belt; and engaging at least a portion of the toner with the plurality of stirring members during the agitating at least a portion of the toner within the reservoir.

* * * * *